US006227633B1

(12) United States Patent
Castillo

(10) Patent No.: US 6,227,633 B1
(45) Date of Patent: May 8, 2001

(54) HEADBAND STORAGE AND STRETCHING DEVICE

(76) Inventor: Sandra Elaine Castillo, 4425 Driftwood Dr., Corpus Christi, TX (US) 78411

( * ) Notice: Subject to any disclaimer, the term of this patent is extended or adjusted under 35 U.S.C. 154(b) by 0 days.

(21) Appl. No.: 08/988,501

(22) Filed: Dec. 10, 1997

(51) Int. Cl.[7] ..... A47B 81/00
(52) U.S. Cl. ..... 312/290; 312/309; 132/212
(58) Field of Search ..... 312/204, 237, 312/290, 284, 309; 206/545, 542; 132/273, 287, 314, 315; 220/503, 528

(56) References Cited

U.S. PATENT DOCUMENTS

| | | | | |
|---|---|---|---|---|
| D. 177,586 | | 5/1956 | Palson . | |
| D. 278,397 | | 4/1985 | Frankenreiter . | |
| D. 319,154 | | 8/1991 | Powell . | |
| 328,588 | * | 10/1885 | Jordan | 132/79 |
| D. 331,161 | | 11/1992 | Liao . | |
| 1,230,453 | * | 6/1917 | Adams | 132/212 |
| 2,300,966 | * | 11/1942 | Roos | 312/309 X |
| 2,597,473 | * | 5/1952 | Green et al. | 132/79 |
| 3,406,811 | * | 10/1968 | Higley | 206/545 |
| 3,957,159 | | 5/1976 | Radek . | |
| 4,934,527 | * | 6/1990 | Ho | 312/309 X |
| 4,998,544 | * | 3/1991 | Obergfell | 132/212 |
| 5,009,366 | | 4/1991 | van Druff, Jr. et al. . | |
| 5,022,528 | * | 6/1991 | Savoy | 206/545 |
| 5,452,806 | | 9/1995 | Campas . | |
| 5,494,347 | | 2/1996 | Poortvliet et al. . | |
| 5,634,560 | | 6/1997 | Phillips . | |
| 5,738,423 | * | 4/1998 | Alfaro | 312/290 |

OTHER PUBLICATIONS

"Document J" is a printout from a patent related database.
"Document K" is a printout from a patent related database.

* cited by examiner

*Primary Examiner*—Peter M. Cuomo
*Assistant Examiner*—Stephen Vu
(74) *Attorney, Agent, or Firm*—George S. Gray

(57) ABSTRACT

A device for the storage and stretching of resilient headbands of the type having two sides joining to form a curved top. The device is described in various embodiments, providing ample storage for a myriad of hair care and styling items typically possessed by ladies and young girls. A frame closely receives the headbands and secures them separately from the various interior and exterior drawers or compartments. Both vertical and horizontal frame positions are described and both are supported by either fixed structure or by a fixed or rotatable base. Both straight and curved frames are provided.

51 Claims, 9 Drawing Sheets

HEADBAND STORAGE AND STRETCHING DEVICE

BACKGROUND

Ladies and young girls typically possess a myriad of personal hair care and styling devices. Included among these devices is the headband. The headband is resilient and has a curved top portion and two sides. The headband is difficult to store efficiently because of its size and tendency to "hook" or "snag" other devices. It is very common for a lady to have several headbands in her collection, which compounds the problem resulting in an often repeated scenario where the storage of hair care and styling devices becomes an entangled and disorganized affair.

Furthermore, headbands, although resilient, often have a high degree of stiffness. This can cause noticeable discomfort when the user resumes wearing it. This stiffness and associated discomfort subsides when the headband is worn for a period of time. This stiffness reduction is due to the "spreading" of the headband, if the headband is maintained in such a "spread" position for a sufficient period of time. However, the stiffness usually returns during the period of time between removal and the next use.

What is needed is a device which stores and secures a lady's collection of headbands, along with other hair care and styling devices, in a manner which eliminates the tendency of the headbands to crowd and entangle the other devices, while simultaneously stretching the headbands in a manner which minimizes initial use discomfort, by reducing the stiffness of the headbands prior to the next use.

SUMMARY OF THE INVENTION

My invention is a device which stores and secures a lady's collection of headbands, along with her other hair care and styling devices. This is done in a manner which eliminates the tendency of the headbands to crowd and entangle the other devices. While being stored the headbands are also being stretched, resulting in stiffness reduction and less wearer discomfort.

The headbands are resilient and have two sides which join to form a curved top portion. My invention has a frame, which has a height, a curved portion, and two sides attached to the curved portion, the frame being shaped to closely receive one or more headbands and hold each headband in place. To resist movement of the headboard with respect to the frame, the frame sides are spaced such that, when the headband is affixed to the frame, the headband ends exert pressure upon the frame sides. This secures the headband on the frame. The frame sides are also spaced such that the distance between the ends of the headband is less than or equal to the frame's maximum width in a plane transverse to the frame height. This resists movement of the headband along planes which are transverse to the frame height.

In an additional embodiment of my invention, the frame's exterior surface is compressible, such that it is compressed when a headband is affixed. The involved compressible material can be thicker along the frame curved portion than along the frame sides. The compressibility can be such that the headband is flush against the frame exterior surface. Such compressibility resists movement of the headband with respect to the frame, both with respect to the frame height (i.e., the longitudinal axis of the frame), and also with respect to the movement in planes which are transverse to such longitudinal axis.

A grooved frame exterior surface can also be used to secure a headband on the frame the groove resisting movement of the headband with respect to the frame.

My invention also includes a frame exterior surface which has a coefficient of friction of sufficient magnitude that the force necessary to move the headband along the frame exceeds a force equal to the force exerted on the headband by gravity, one "gravity" being approximately 32.2 feet per second per second.

In an additional embodiment, planar shaped end pieces can be attached to the ends of the frame, preventing motion of the headband beyond the end of the frame.

My invention can be utilized in a vertical or a horizontal orientation.

Furthermore, my invention can be readily adapted to provide numerous means of storage for other hair care and styling items. These storage means, while part of the same device, provide for separation of the headbands, which are affixed to the frame, and the other items, which are contained or secured elsewhere. For example, drawers and drawer support means can be situated within the frame interior providing sufficient storage for numerous hair care and styling items. The drawers in one such embodiment open and close in a line of travel that is substantially perpendicular to the frame height. Other drawer configurations include one or more drawers which open and close in a line of travel that parallels the frame height, while using all or part of the frame interior.

Drawers and drawer support means attached to the exterior of the frame are also provided which enhances the storage capacity of my invention. Such exterior drawers can be attached in a manner which supports the frame.

In an additional embodiment of my invention, the frame is enclosed and an opening is provided, allowing access to the enclosure for the placement or retrieval of hair care and styling items. The opening is provided, both with and without means to close or cover the opening, the closing and covering means including doors and both removable and attached covers. In the vertical and horizontal configurations, a door is provided which swings along an axis which is substantially parallel to the frame height. In the horizontal configuration a cover is provided. In additional embodiments, mirrors are mounted to the interior surface of the door or cover. Such doors and covers are also provided with pouches attached to their interior surfaces for additional storage space.

When the frame is positioned horizontally, the uncovered opening allows the vertical storage of longer items such as brushes and combs, which conveniently extend beyond the frame interior where they can be reached easily. Furthermore, the portion of the frame enclosure in the proximity of the opening can be isolated by partitions within the enclosure. Such an embodiment is particularly compatible with one or more end drawers which move in a direction which is parallel to the frame height.

Furthermore, my invention includes an embodiment which provides extensions from the frame, such as arms, which can be sized, shaped and positioned to provide storage for rings, bracelets, necklaces, scrunchies, etc.

In other embodiments an exterior container is provided which attaches to the frame, thus providing additional storage.

My device can be supported in numerous ways. A substantially flat bottom end of the frame can support the device, and if the frame top end is also substantially flat, the support means is reversible, i.e. the device can be supported while inverted. In an additional embodiment, a base, with a rotatable portion, provides the ability to the rotate the device. The rotation feature is applied to both the vertical and the horizontal configurations.

Furthermore, for practical or aesthetic purposes the frame can be curved along its axis into numerous shapes.

DESCRIPTION OF THE DRAWINGS

These and other features, aspects, and advantages of the present invention will become better understood with regard to the following description, appended claims, and accompanying drawings where:

DESCRIPTION

Figure 1:
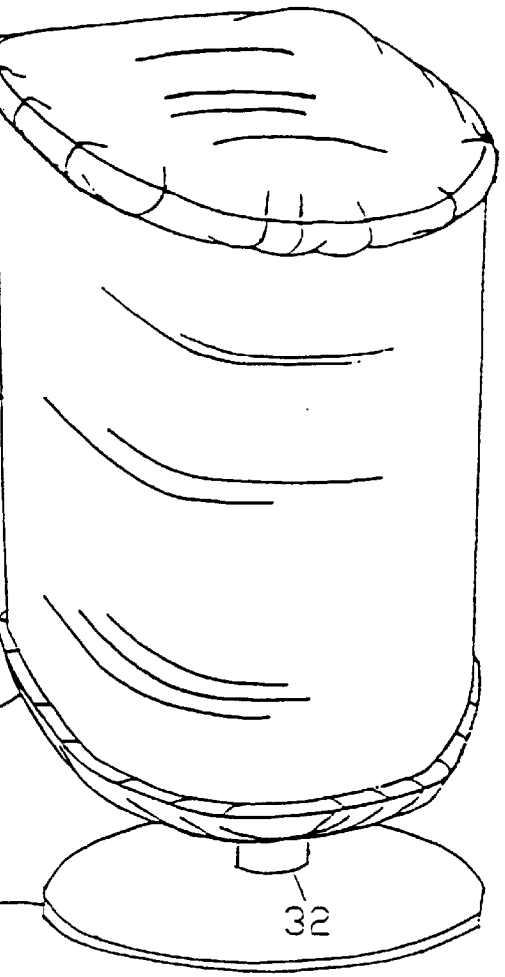
FIG. 1 shows an oblique view of the device, when the frame is positioned vertically.
Figure 2:
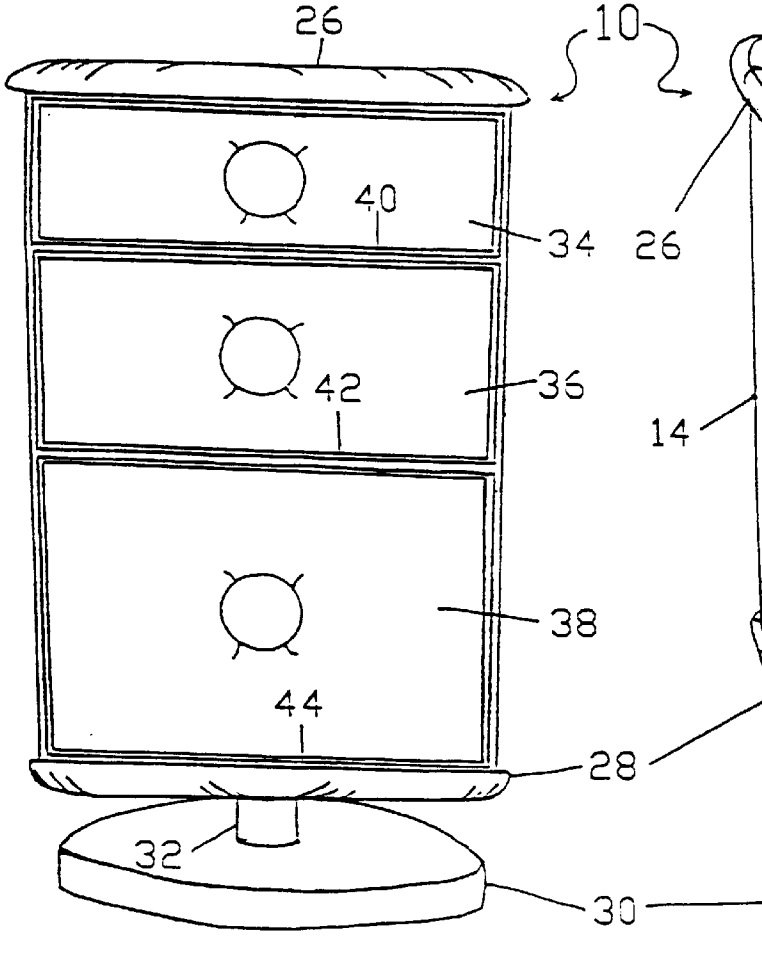
FIG. 2 is a side view of the device shown obliquely in FIG. 1.
Figure 3:
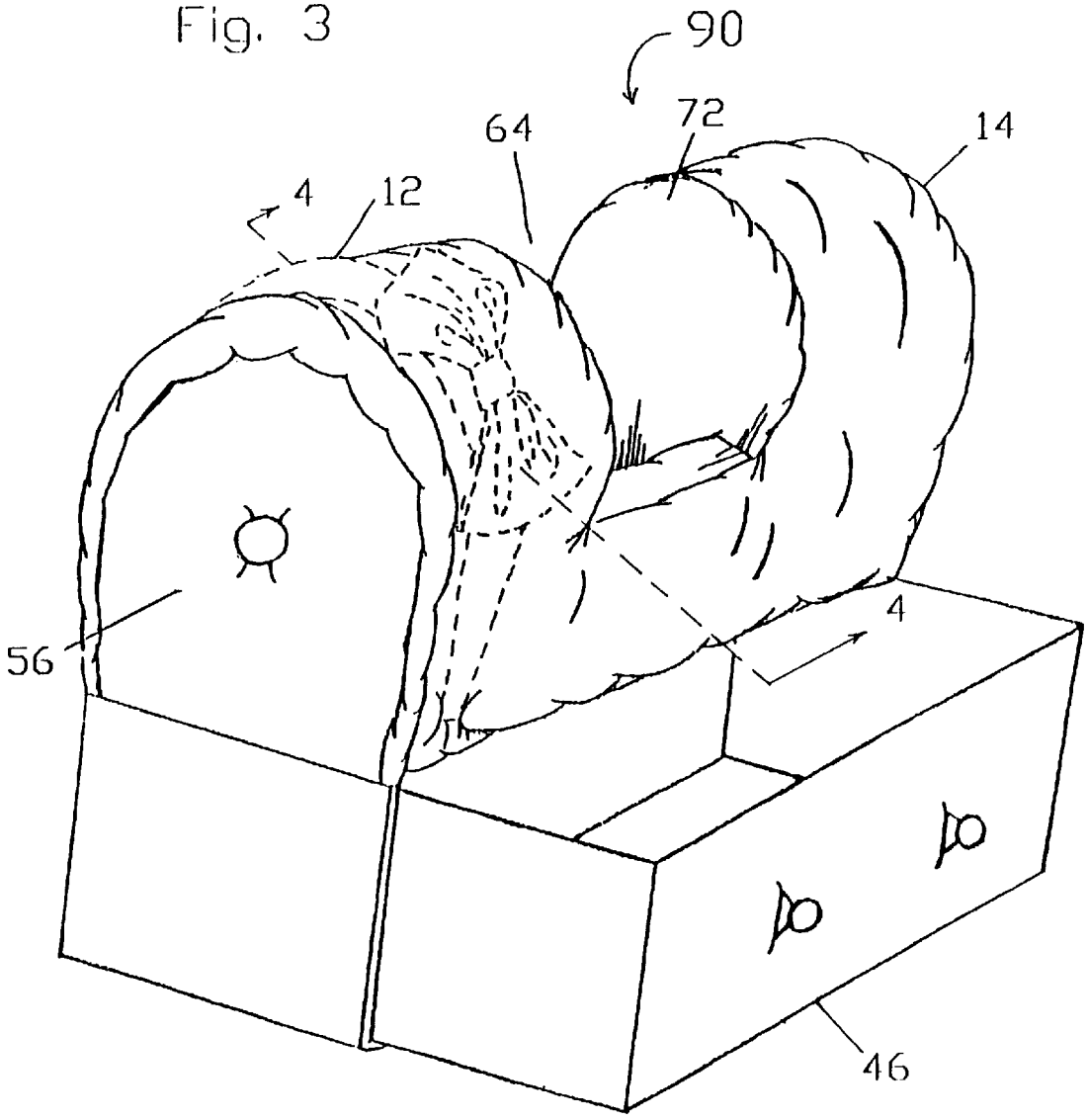
FIG. 3 is an oblique view an embodiment of the device, when the frame is positioned horizontally.
Figure 4:
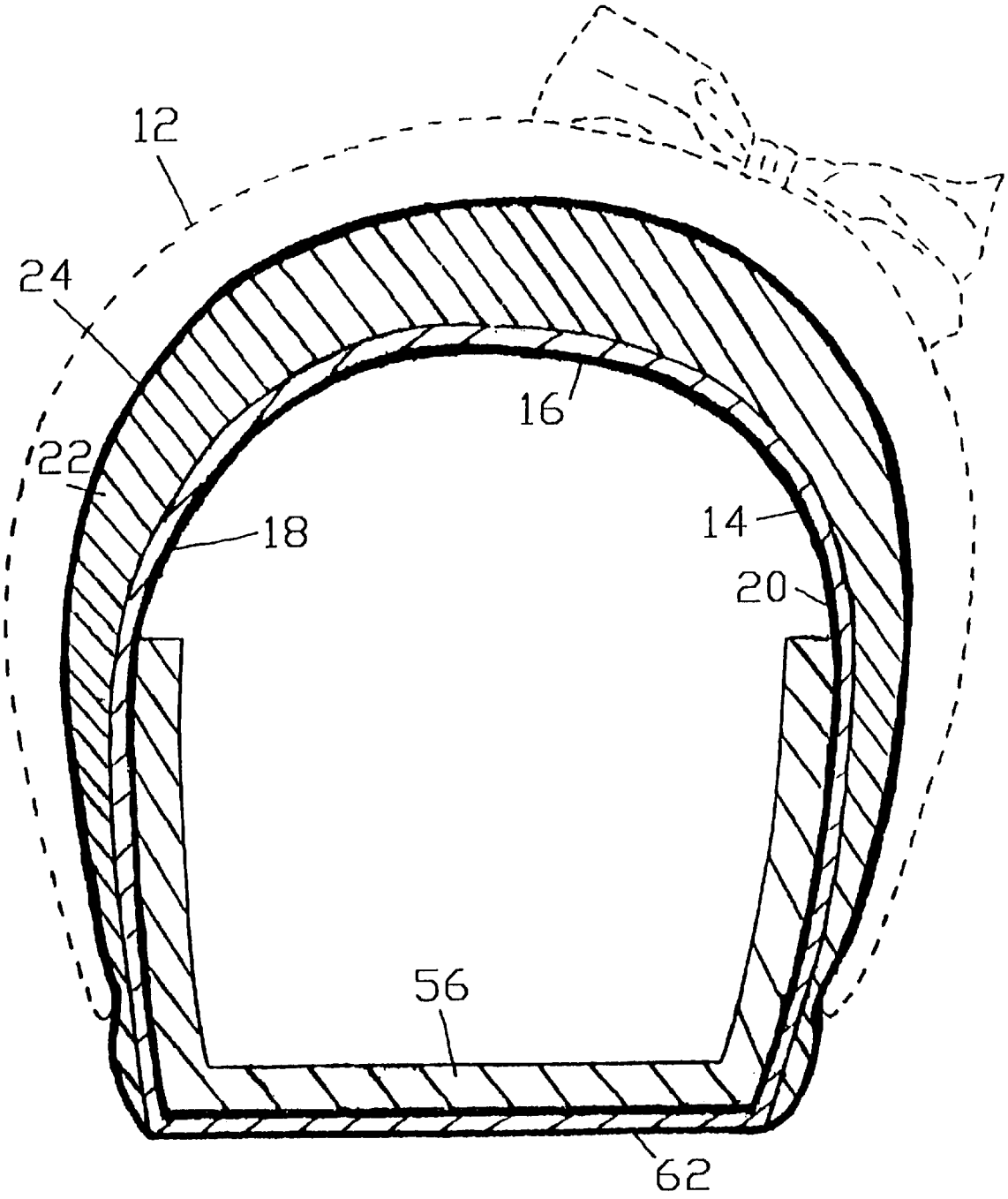
FIG. 4 is a sectional view of the device shown obliquely in FIG. 3, along cutting plane 4—4.

Vertically and horizontally configured embodiments of the headband storage and stretching device 10,90 are depicted in FIGS. 1–3. FIG. 4 depicts a cross section of the frame 14 portion of the horizontal embodiment 90, showing a cross-section of a headband 12 and the frame 14, the frame curved portion 16, the frame first side 18, the frame second side 20, the compressible material 22, and the covering material 24. The frame curved portion 16 and sides 18,20 are made of cardboard, although other materials, e.g plastic, fiberglass, wood, sheet metal, etc. could be substituted. The compressible material 22 is made of urethane sponge, although other materials can be adapted for use, including flexible foams, rubber sponge, foam rubber, cellular rubber, cellular plastics, etc. The covering material 24 is made of cotton, although a number of materials could be substituted, e.g. polyester, rayon, velvet, polyfiller, felt, terry cloth, silk, etc. The involved compressible material 22 can be thicker along the frame curved portion 16 than along the frame sides 18,20.

Some of these materials will have a coefficient of friction of sufficient magnitude that the force necessary to move the headband along the frame exceeds a force equal to the force exerted on the headband by gravity, one "gravity" being approximately 32.2 feet per second per second and denoted herein as "1 G." The ability of a material to resist headband movement to that extent will be determined by the type material and its thickness. Successful material and material thickness selections will occur to those of skill in the art.

To resist movement of the headband 12 with respect to the frame 14, the frame sides 18,20 and frame curved portion 16 can be spacced such that, 3when the headband 12 is affixed to the frame 14, the headband 12 ends exert pressure uupon the frame sides 18,20. Furthermore, the compressibility of the frame exterior surface 22,24 provides resistance to movement of the headband 12 with respect to the frame 14. Additionally, when the distance between the headband 12 ends is less that or equal to the frame 14 maximum width, movement of the headband 12 is resisted in planes which are tranverse to the frame 14 height. This relationship can be achieved with or without the compressibility of the frame exterior surface 22,24.

As shown in FIG. 4, the compressible material 24 can be dimensioned such that is thicker along the frame curved portion 16, than along the frame sides 18,20. This can assist in providing a flush fit of the headband 12 against the frame exterior surface 24.

Additional vertically and horizontally configured embodiments 100,110,120,130,140 are shown in FIGS. 5–10.

Planar end portions 26, 28 are attached to the frame 14, as shown in FIGS. 1–2. In this vertically configured embodiment 10, a base 30, with a rotatable portion 32, are attached to the planar end portion 28, allowing the device to be rotated. This embodiment has interior drawers 34,36,38, which are supported by partitions 40,42,44 added within the frame 14, as shown in FIG. 2.

Horizontal configurations 90,120,130,140 have an exterior drawer 46 contained within a structural enclosure 48, which also supports the frame 14.

Figure 5:
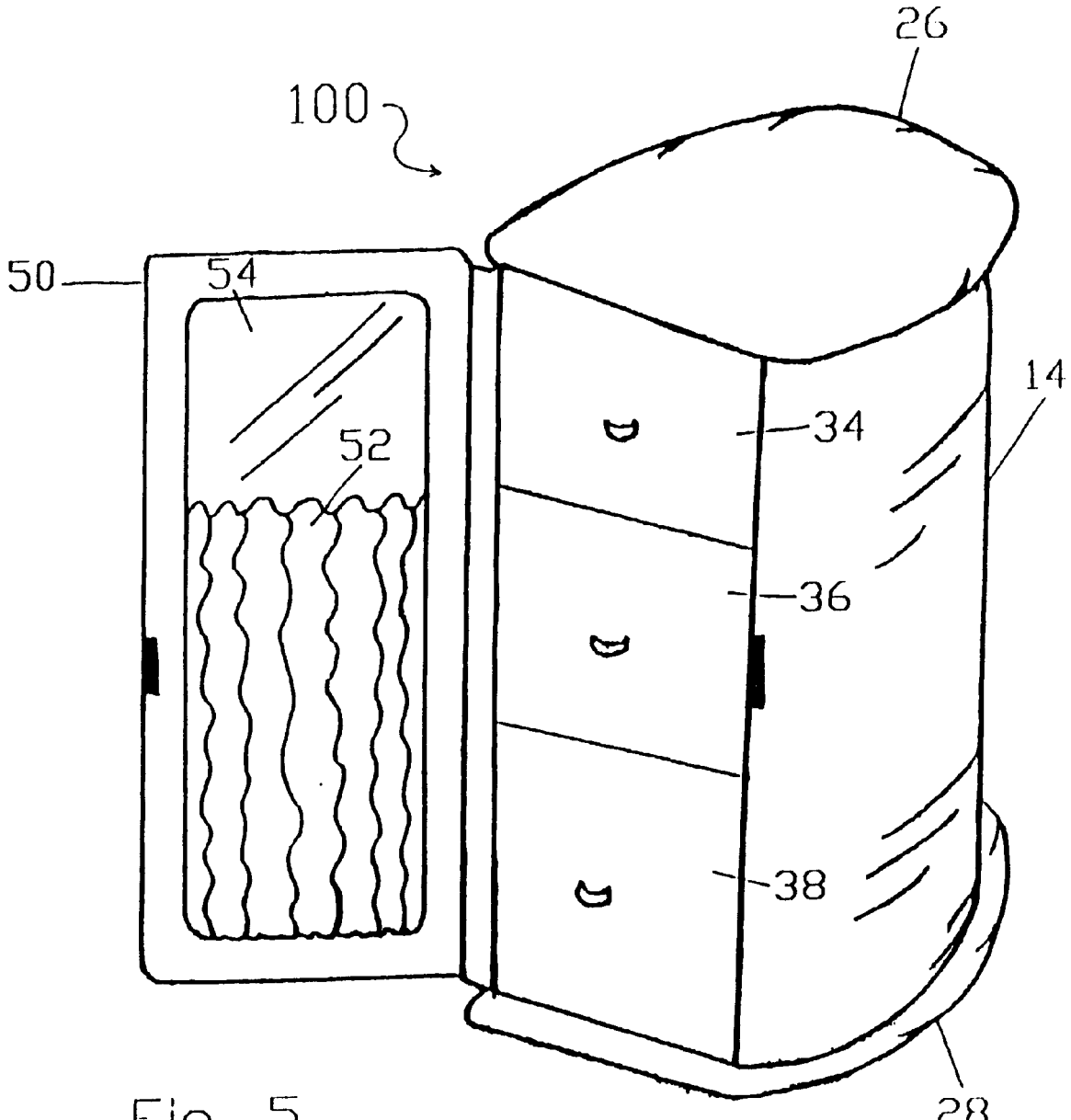
FIG. 5 is an oblique view of the device in an additional vertically configured embodiment.

In an additional vertically configured embodiment 100 a door 50 swings about an axis which allows the concealment of the interior drawers 34,36,38 as shown in FIG. 5. The door 50 has an attached pouch 52 and a mirror 54.

Figure 8:
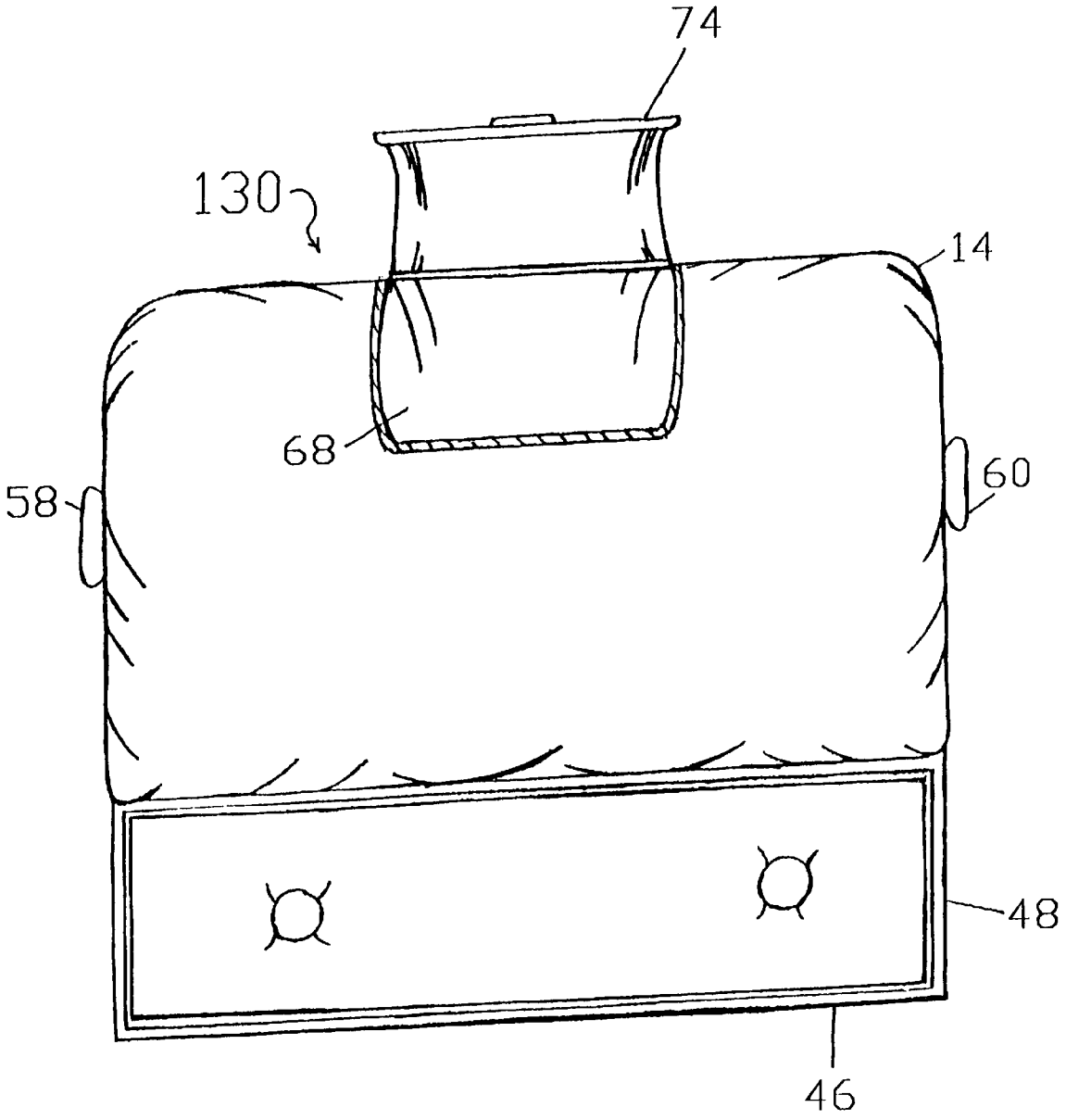
FIG. 8 is a front view of the device in an additional horizontally configured embodiment.
Figure 9:
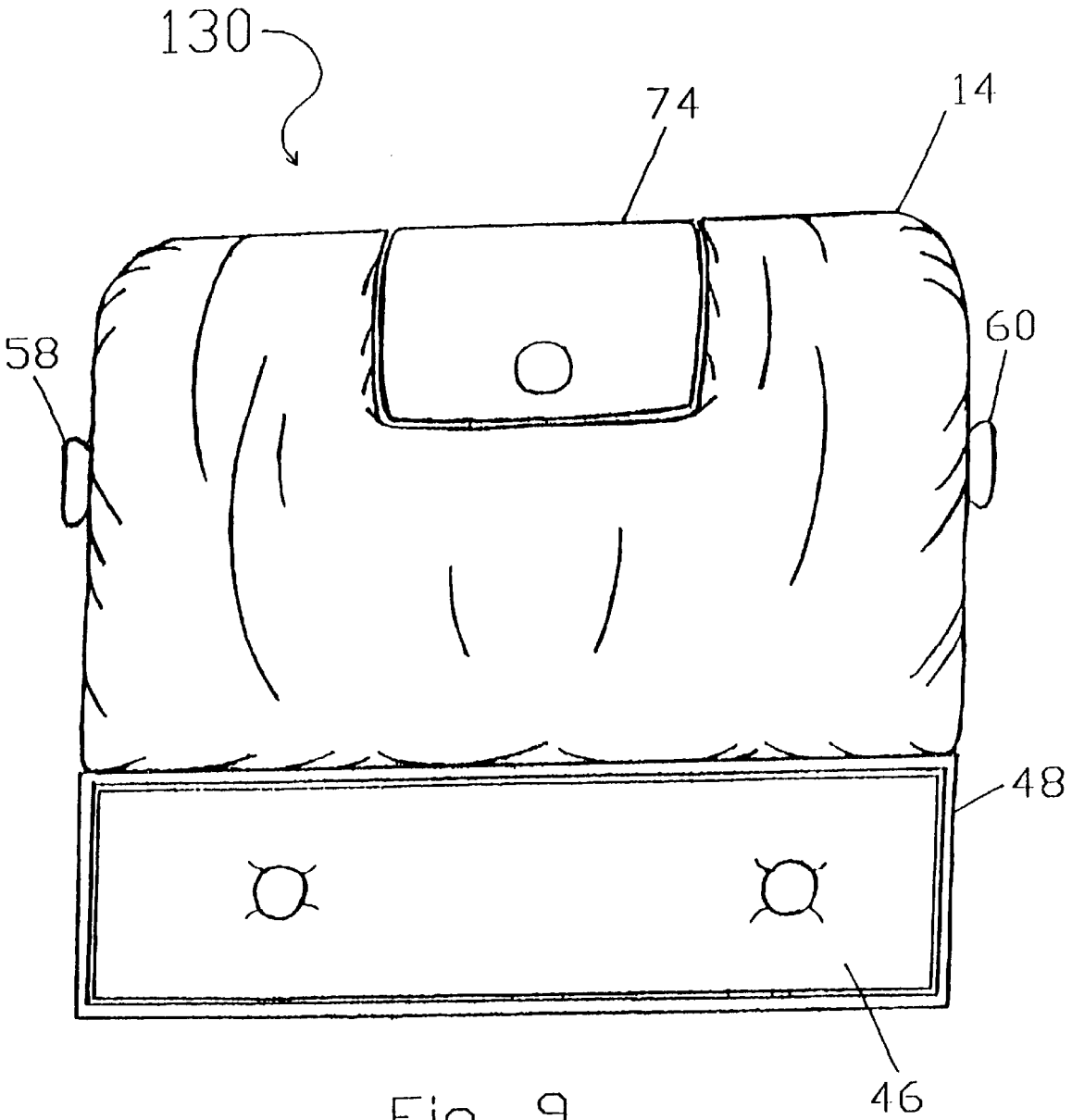
FIG. 9 is a front view of the device in an additional horizontally configured embodiment.

Horizontal configurations 90,130 include interior drawers 56,58,60 which open in a direction parallel to the axis of the frame 14, as shown in FIGS. 3, 8–9. An additional drawer opposes the drawer 56 although not visible on FIG. 3. FIG. 4 shows a cross-section of the drawer 56, as well as, the frame third side 62, which supports the drawer 56.

Interior and exterior drawers 34,36,38,46,56,58,60 and drawer supports 40,42,44,48,62 are made from cardboard, although other materials could be substituted, e.g. plastic, fiberglass, wood, sheet metal, etc.

In horizontal configurations 90,120,130,140 openings 64,66,68,70 are provided to allow access to the frame 14, as shown in FIGS. 3, 7–10. Symmetrical partitions 72 isolate a portion of the frame 14 interior in the embodiments 90,130 shown in FIGS. 3, 8–9. The embodiments 120,140 shown in FIGS. 7, 10 have no partitions, allowing access to all the frame 14 interior. A hinged cover 74 is provided in one embodiment 130, as shown in FIGS. 8–9.

Figure 6:
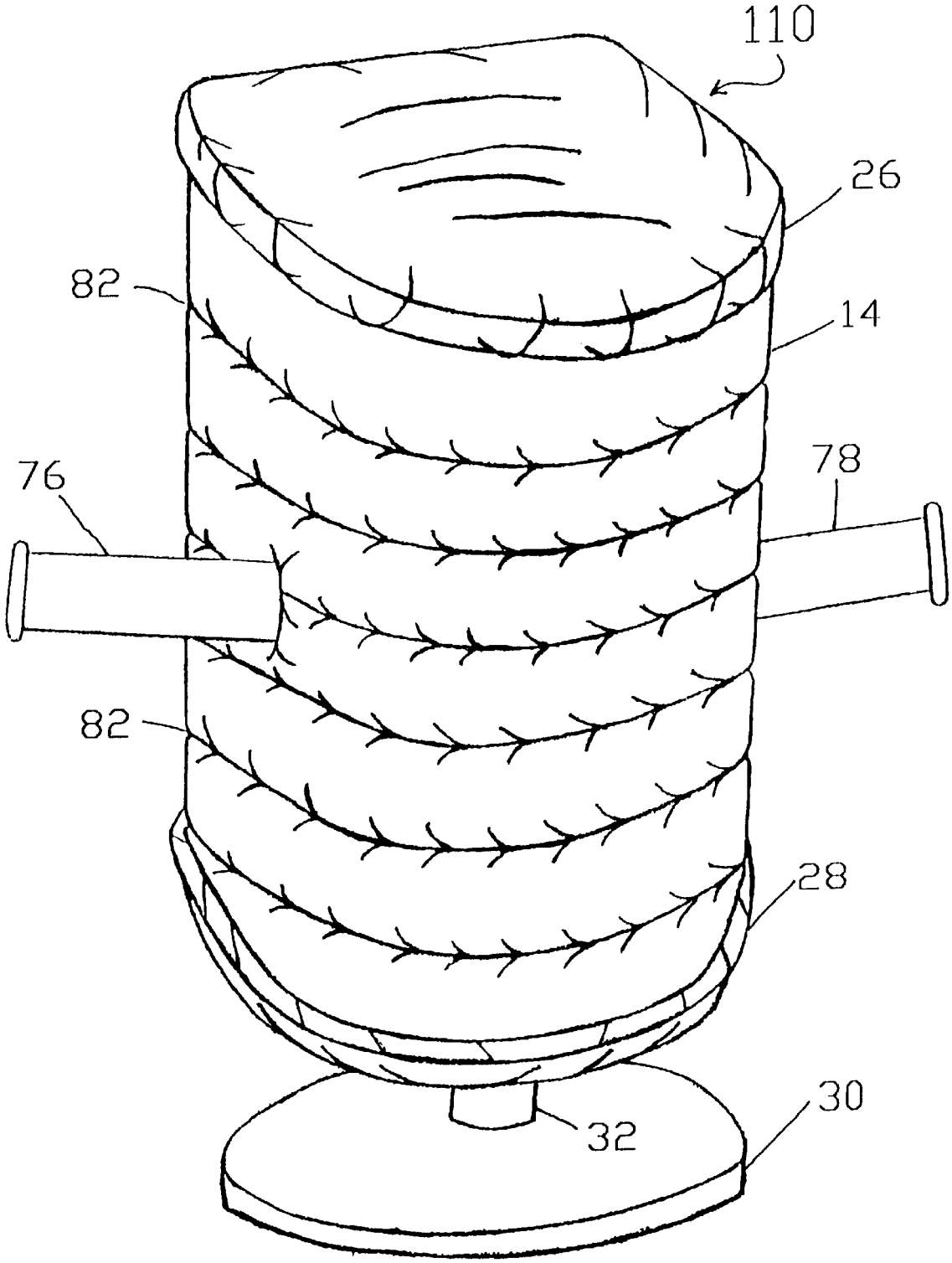
FIG. 6 is an oblique view of the device in an additional vertically configured embodiment.
Figure 7:
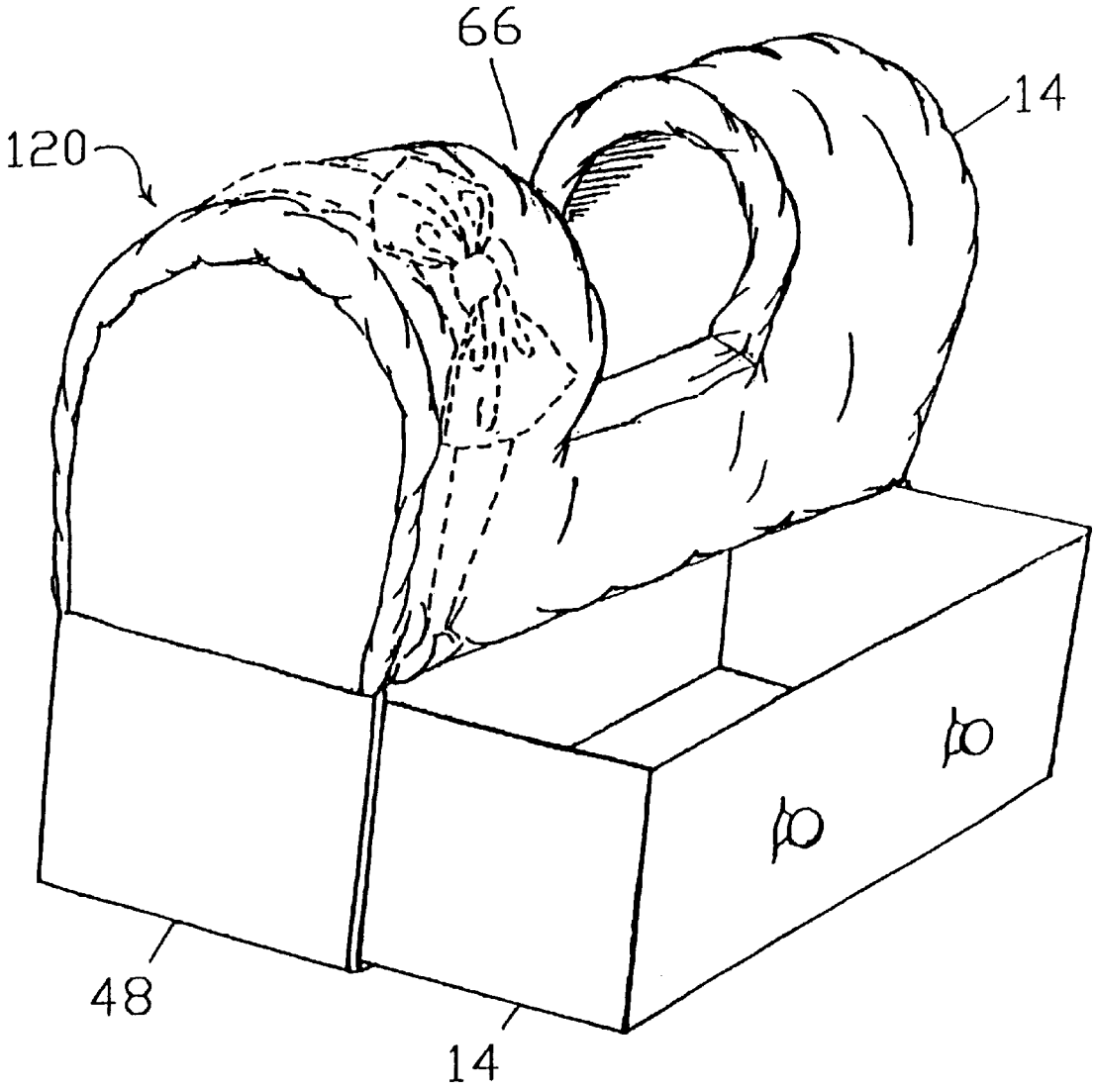
FIG. 7 is an oblique view of the device in an additional horizontally configured embodiment.

Additional storage means are provided in an embodiment 110 in the form of two arms 76,78 which extend from the frame 14, as shown in FIG. 6. The arms 76,78 can be made of any relatively stiff material, and can be sized, shaped, and positioned to provide loose or snug storage for rings, bracelets, necklaces, scrunchies, etc.

Grooves 82 in the frame 14 exterior surface are shown in FIG. 6, although the size, depth, width, and shape of such grooves 82 can be easily modified. Such grooves 82 resist movement of the headband with respect to the frame.

Figure 10:
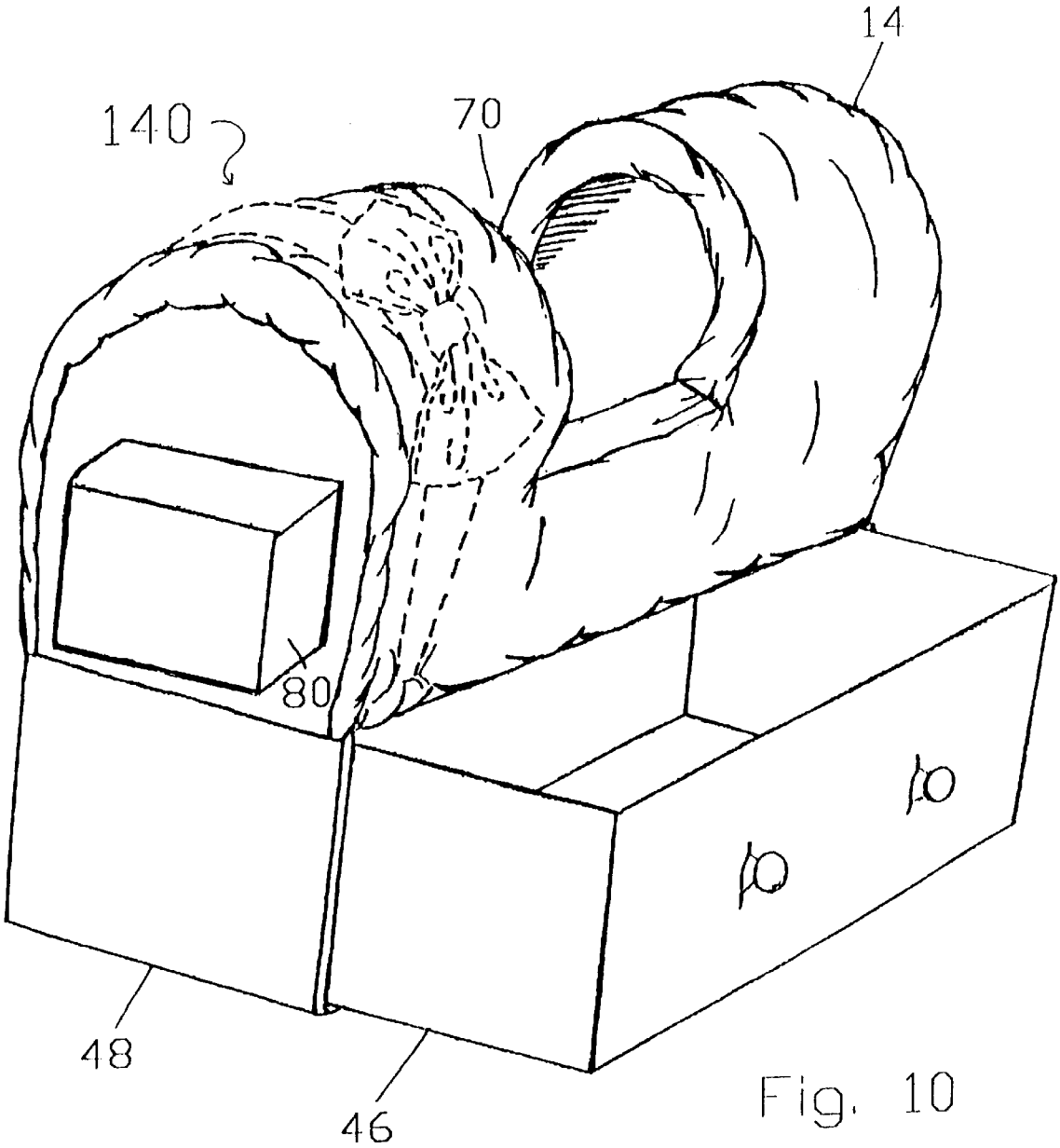
FIG. 10 is an oblique view of the device in an additional horizontally configured embodiment.

In an additional embodiment 140 an exterior container 80 is provided for additional storage, as shown in FIG. 10. While the container 80 shown is open, it is contemplated that the container can also be enclosed or covered, stiff walled, flexible, etc. The size and shape of the container 80 can also be adjusted.

While the above embodiments 90,100,110,120,130,140 have a generally straight frame 14, my invention also contemplates a curved frame. The resulting frame shapes could be in the form of an arch, crescent, alphabet character, numeral, circle, or numerous other shapes. Drawers, openings, covers, bases and other related features of my invention, can be modified, as to shape and size, to fit the curve or curves.

Although the present invention has been described in considerable detail with reference to various embodiments thereof, other embodiments are possible. Accordingly, the spirit and scope of the appended claims should not be limited to the description of the embodiments contained herein.

I claim:

1. A device for securing one or more resilient headbands, each of the headbands having two ends and two sides, with each said side joining a curved top portion, the device comprising:

(a) a frame having a height, a curved portion, an exterior surface, a maximum width, a first side, and a second side, the first and second sides being opposite each other and joined to the curved portion, wherein the curved portion and the sides being adapted to closely receive the headband; and (b) headband movement resistance means for resisting movement of the headband with respect to the frame, wherein the frame exterior surface is compressed by the headband, the maximum width being at least equal to the distance between the received headband ends.

2. The device of claim 1, wherein the headband is received by the frame, the headband ends exert pressure upon the frame sides.

3. The device of claim 2, wherein the pressure exerted upon the frame sides is of such magnitude that, when the headband is received by the frame, the force necessary to move the headband along the frame height exceeds 1 G.

4. The device of claim 1, wherein the compression of the frame exterior surface is of such magnitude that, when the headband is received by the frame, the headband is flushed against the frame exterior surface.

5. The device of claim 1, wherein the compressibility of the frame exterior surface is such that, when the headband is received by the frame, the headband sides are spread.

6. The device of claim 1, wherein the frame exterior surface comprises a layer of compressible material covering at least part of the device.

7. The device of claim 6, wherein the compressible material is flexible foam.

8. The device of claim 6, wherein the layer of compressible material is thicker along the frame curved portion than along the frame sides.

9. The device of claim 6, wherein the frame exterior surface further comprises a layer of material surrounding the layer of compressible material, wherein the layer of material restrains the layer of compressible material.

10. The device of claim 1, wherein the frame exterior surface has a coefficient of friction such that, when the headband is received by the frame, the force necessary to move the headband along the frame height exceeds 1 G.

11. The device of claim 1, wherein the headband movement resistance means comprises the frame curved portion, the frame curved portion further having a groove running transversely to the frame height.

12. The device of claim 1, wherein the frame further has a top end, a bottom end, a top end portion and a bottom end portion, whereby the frame top end portion and bottom end portion each being generally planar and sized to extend beyond the frame exterior surface when attached to the frame top and the bottom ends, respectively, said attachment being configured such that both the top and the bottom end portions are transverse to the frame height.

13. The device of claim 1, further comprising storage means for storing miscellaneous articles.

14. The device of claim 13, wherein the storage means comprises a frame interior drawer.

15. The device of claim 14, wherein the frame interior drawer comprises a plurality of drawers and drawer support means for supporting the drawers, each of the drawers having a plane of travel transverse to the frame height and substantially horizontal, the drawer support means being attached to the frame, wherein the drawer and the drawer support means being configured such that the drawer is substantially within the frame interior when the drawer is closed.

16. The device of claim 14, wherein the frame interior drawer comprises a drawer and drawer support means for supporting the drawer, the drawer having a plane of travel parallel to the frame height and substantially horizontal, the drawer support means being attached to the frame, wherein the drawer and the drawer support means being configured such that the drawer is substantially within the frame interior when the drawer is closed.

17. The device of claim 14, wherein the frame interior drawer comprises a drawer and drawer support means for supporting the drawer, the drawer having a plane of travel parallel to the frame height and substantially horizontal, the drawer support means being attached to the frame, wherein the drawer and the drawer support means being configured such that the drawer is substantially within the frame interior when the drawer is closed.

18. The device of claim 14, wherein the frame interior drawer comprises two drawers and drawer support means for supporting the drawers, each of the drawers having a plane of travel being parallel to the frame height and substantially horizontal, the drawer support means being attached to the frame, whereby the drawers and the drawer support means being configured such that the drawers are substantially within the frame interior when the drawers are closed.

19. The device of claim 13, wherein the storage means comprises a frame exterior drawer.

20. The device of claim 19, wherein the exterior drawer comprises a drawer and drawer support means for supporting the drawer, the drawer support means further being attached to the frame, and the drawer and drawer support means are configured such that the drawer is not within the frame interior.

21. The device of claim 20, wherein the drawer and drawer support means are attached to the frame such that, when the frame is positioned horizontally, the drawer supports the frame.

22. The device of claim 13, wherein the frame further comprises:

a third side attached to the frame first and second sides, the frame further having a first end and a second end;

a first end portion and a second end portion, the first end portion and second end portion being attached to the frame at the frame first end and the frame second end, respectively, such that an enclosure is formed within the frame; and the frame further having an opening, situated on the frame such that access to the frame enclosure is provided.

23. The device of claim 22, further comprising closure means for closing the frame such that the frame opening may be closed and reopened.

24. The device of claim 23, wherein the closure means comprises a hinged cover.

25. The device of claim 24, wherein a mirror is attached to the hinged cover.

26. The device of claim 24, wherein a pouch is attached to the hinged cover.

27. The device of claim 24, wherein the hinge portion of the hinged cover is substantially parallel to the frame height.

28. The device of claim 24, wherein the hinge portion of the hinged cover is substantially perpendicular to the frame height.

29. The device of claim 24, wherein the hinged cover is a door, the door swinging on an axis substantially parallel to the frame height.

30. The device of claim 29, further comprising storage means for storing miscellaneous articles having a plurality of drawers and drawer support means for supporting the drawers, the drawer support means being attached to the frame such that the drawers are substantially within the frame enclosure when closed, and being further attached such that access to the drawers is provided by opening the door.

31. The device of claim 23, wherein the closure means comprises a removable cover.

32. The device of claim 23, further comprising storage means for storing miscellaneous articles having a plurality of drawers and drawer support means for supporting the drawers, the drawer support means being attached to the frame such that the drawers are substantially within the frame enclosure when closed, and being further attached such that access to the drawers is provided by opening the door.

33. The device of claim 22, further comprising an enclosure partition, the enclosure partition being placed in the frame enclosure such that access to the frame enclosure through the frame opening does not extend to the entire frame enclosure.

34. The device of claim 13, wherein the storage means comprises an exterior container, the exterior container being attached to the frame.

35. The device of claim 13, wherein the storage means comprises an extension attached to the frame.

36. The device of claim 35, wherein the extension comprises an arm.

37. The device of claim 1, further comprising support means from supporting the frame.

38. The device of claim 37, wherein the frame has a bottom end and a bottom end portion, the frame bottom end portion being generally planar, the frame bottom end portion being attached to the frame bottom end such that the frame bottom end portion is transverse to the frame height.

39. The device of claim 37, wherein the frame has a top end, a bottom end, a top end portion and a bottom end portion, the frame top end portion and bottom end portion each being generally planar and each being attached to the frame top and bottom ends, respectively, such that both the top and bottom end portions are transverse to the frame height.

40. The device of claim 37, wherein the frame has a bottom end, the support means further comprising a base, the base having a rotatable portion, the frame bottom end being attached to the frame rotatable portion.

41. The device of claim 37, wherein the frame has a top end, a bottom end, a top end portion and a bottom end portion, the frame top end portion and bottom end portion each being generally planar and sized to extend beyond the frame when attached to the frame top and bottom ends, respectively, such attachment being configured such that both the top and bottom end portions are transverse to the frame height, the attachment being further configured such that, when the frame is positioned horizontally, the top and bottom end portions support the frame above the surface.

42. The device of claim 37, wherein the support means comprises a base, the base being attached to the frame such that, when the frame is positioned horizontally, the base supports the frame.

43. The device of claim 1, further comprising rotation means for rotating the frame.

44. The device of claim 43, wherein the frame has a bottom end end the rotation means comprises the frame, a the base having a rotatable portion, the frame bottom end being attached to the frame rotatable portion.

45. The device of claim 43, wherein the rotation means comprises a base, the base having a rotatable portion, the base rotatable portion being attached to the frame such that, when the frame is positioned horizontally, the base supports the frame.

46. The device of claim 1, the frame further having a frame first end, a frame second end, and an axis running between the frame first and second ends, the axis being curved.

47. The device of claim 46, wherein the curve of the axis is arch shaped.

48. A device for securing one or more resilient headbands, each of the headbands having two ends and two sides, with each said side joining a curved top portion, the device comprising:

a frame having a height, a curved portion, a maximum width, an exterior surface, a first side, a second side, the first and second sides being opposite each other and joined to the curved portion, the curved portion and sides being adapted to closely receive the headband, such that the maximum width is at least equal to the distance between the received headband ends, the frame exterior surface being compressible, such that, when the headband is received by the frame, the headband ends exert pressure upon the frame sides.

49. The device of claim 48, wherein the pressure exerted upon the frame sides is of such magnitude that, when the headband is received by the frame, the force necessary to move the headband along the frame height exceeds 1 G.

50. A device for securing one or more resilient headbands, each of the headbands having two ends and two sides, with each said side joining a curved top portion, the device comprising:

(a) means for closely receiving the headband, said means comprising a frame having a height, a curved portion, an exterior surface, a maximum width, a first side, and a second side, the first and second sides being opposite each other and joined to the curved portion, wherein the curved portion and the sides being adapted to closely receive each of the headbands; and (b) headband movement resistance means for resisting movement of the headband with respect to the frame, wherein the frame exterior surface is compressed by the headband, the maximum width is at least equal to the distance between the received headband ends.

51. A device comprising:

(a) one or more headbands, each of the headbands having two ends, two sides, and a curved portion, each said side joining the curved portion; and (b) a frame, having a height, a curved portion, a maximum width, an exterior surface, a first side, and a second side, the first and second sides being opposite each other and joined to the curved portion, whereby the curved portion and sides being adapted to closely receive each of the headbands, such that the maximum width is at least equal to the distance between the received headband ends, wherein the frame exterior surface being compressible.

* * * * *